US007878341B2

(12) United States Patent
Ming

(10) Patent No.: US 7,878,341 B2
(45) Date of Patent: Feb. 1, 2011

(54) APPARATUS FOR STORING ACCESSORY CASES

(75) Inventor: Wang Fu Ming, Suzhou (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 1439 days.

(21) Appl. No.: 11/318,096

(22) Filed: Dec. 23, 2005

(65) Prior Publication Data

US 2006/0237339 A1 Oct. 26, 2006

(30) Foreign Application Priority Data

Dec. 27, 2004 (CN) ..... 2004 2 0054806

(51) Int. Cl.
*A47B 73/00* (2006.01)

(52) U.S. Cl. ..... 211/78; 211/164

(58) Field of Classification Search ..... 211/1.52, 211/1.53, 1.55, 53, 70, 70.6, 78, 163, 164; 206/372, 373, 377, 379; 483/65, 66, 67
See application file for complete search history.

(56) References Cited

U.S. PATENT DOCUMENTS

| | | | | |
|---|---|---|---|---|
| 1,558,376 | A * | 10/1925 | Lewis et al. | 40/379 |
| 2,646,891 | A | 7/1953 | Morgan | |
| 3,279,470 | A * | 10/1966 | Neilsen | 211/115 |
| 4,126,366 | A | 11/1978 | Handler et al. | |
| 4,920,631 | A * | 5/1990 | Novak | 483/61 |
| 5,259,502 | A | 11/1993 | Chan | |
| 5,660,361 | A | 8/1997 | Penger | |
| 5,672,145 | A * | 9/1997 | Pollington et al. | 483/59 |
| 5,984,441 | A * | 11/1999 | Stokhuijzen | 312/240 |
| 6,899,233 | B2 * | 5/2005 | Taylor | 211/40 |
| 2005/0040062 | A1 * | 2/2005 | Chang | 206/373 |

FOREIGN PATENT DOCUMENTS

| | | |
|---|---|---|
| CA | 2 451 537 | 3/2004 |
| DE | 949 161 | 9/1956 |
| EP | 1 366 866 A1 | 12/2003 |

OTHER PUBLICATIONS

European Search Report of EP 05257919, Date: Apr. 28, 2006.

* cited by examiner

*Primary Examiner*—Darnell M Jayne
*Assistant Examiner*—Patrick Hawn
(74) *Attorney, Agent, or Firm*—Factor & Lake, Ltd.

(57) ABSTRACT

The present invention provides an apparatus that comprises multiple cases capable of storing power tool accessories and a carousel. The carousel may comprise support plates with grooves on it and retaining covers. The accessory cases are pivotal with respect to the support plates. Each accessory case can be dismounted when the accessory case pivots to align with the grooves. In accordance with the invention, the use of accessory cases become very convenient. An accessory case can be straightforwardly dismounted from the apparatus and be carried by the user without the need for the whole apparatus to be carried.

19 Claims, 10 Drawing Sheets

APPARATUS FOR STORING ACCESSORY CASES

CROSS REFERENCE TO RELATED APPLICATIONS

This application claims priority to Chinese patent application number 200420054806.0, filed Dec. 27, 2004, which is incorporated herein by reference.

FIELD OF THE INVENTION

The present invention relates to an improved apparatus for storing accessory cases.

BACKGROUND

Many types of apparatus for storage or transportation of tools or accessories are commercially available. The apparatus may be made of metal or plastic. Certain apparatus are provided with multiple independent accessory cases which can be ordered in any sequence. Other apparatus are provided with multiple independent accessory cases which are pivotal with respect to each other.

U.S. Pat. No. 5,259,502 discloses an assembly of multiple tool cases which are connected to each other by an axle or inserting rod so that they are pivotal with respect to the axle or inserting rod such that the tool case can be selectively opened. In this way, the assembly of tool cases forms a compact construction. However these tool cases are inconvenient and difficult to disassemble (for example when a case is broken and needs to be repaired). In addition, the assembly cannot be conveniently disassembled for carriage or transport.

SUMMARY OF THE INVENTION

In order to overcome the foregoing disadvantages, it is an object of the invention to provide an improved apparatus that is assembled easily.

In an embodiment, the present invention provides an apparatus that comprises multiple cases capable of storing power tool accessories and a carousel. The carousel may comprise support plates with grooves on it and retaining covers. The accessory cases are pivotal with respect to the support plates. Each accessory case can be dismounted when the accessory case pivots to align with the grooves. In accordance with the invention, the use of accessory cases become very convenient. An accessory case can be straightforwardly dismounted from the apparatus and be carried by the user without the need for the whole apparatus to be carried.

In an embodiment, the present invention provides an apparatus for storing a plurality of accessory cases comprising:

a carousel; and a plurality of accessory cases for storing power tool accessories mounted substantially radially on the carousel, wherein each of the plurality of accessory cases is selectively dismountable radially from the carousel only at one or more rotationally selected positions.

Typically the carousel is horizontally disposed.

Preferably each accessory case is selectively dismountable from the carousel only at a single rotationally selected position.

In a preferred embodiment, the carousel comprises:

a rotary connection shaft for rotating the plurality of accessory cases; and at least one support plate joined to an end of the rotary connection shaft, wherein the at least one support plate supports each of the plurality of accessory cases in a substantially radial position; and a pair of retaining covers mounted adjacent to the ends of the connection shaft to retain each of the plurality of accessory cases in the substantially radial position, wherein each of the plurality of accessory cases is selectively dismountable from the carousel only at one or more positions of the at least one support plate relative to the pair of retaining covers selected by rotation of the at least one support plate.

Each retaining cover is typically cup-shaped (e.g. with a concave inner face). The at least one support plate may be mounted at the rear face of the retaining cover (e.g. on support ribs upstanding from the concave inner face).

Preferably each retaining cover comprises a retaining collar or retaining flange for retaining the plurality of accessory cases in the substantially radial position, wherein each retaining collar or retaining flange has a groove and wherein the grooves of each retaining collar or retaining flange are in axial alignment so as to permit one of the plurality of accessory cases when rotationally aligned with the grooves to be dismounted radially. The retaining collar or retaining flange is typically an extension of the concave inner face.

Preferably the at least one support plate is a pair of support plates joined to opposite ends of the rotary connection shaft and supported at the rear face of the retaining covers.

Preferably each accessory case comprises a pair of lateral sliding members slidable through the grooves into a rear volume of the retaining cover.

Particularly each support plate comprises a plurality of circumferentially spaced apart radial guide slots through each of which the lateral sliding member is slidable into the rear volume of the retaining cover.

Preferably each retaining cover comprises a retaining collar extending axially to a lateral edge of the plurality of accessory cases to confine the lateral sliding member in the rear volume of the retaining cover to retain the plurality of accessory cases in the substantially radial position.

Preferably each accessory case further comprises a guide block adjacent to each sliding member, wherein each radial guide slot comprises a first slot portion and a second slot portion communicating with the first slot portion, wherein the guide block is slidable into the first slot portion and the width of the second slot portion is greater than the width of the first slot portion so that the lateral sliding member is slidable through and out of the second slot portion into the rear volume of the retaining cover.

Preferably each support plate further comprises a plurality of axially projecting guide walls surrounding each radial guide slot to slidingly receive the lateral edge of the accessory cases.

Preferably the at least one support plate is a single support plate joined to an end of the rotary connection shaft and supported at the rear face of one of the retaining covers.

Preferably the support plate comprises a plate body supported at the rear face of one of the retaining covers and multiple pairs of radial guide arms extending axially from the plate body.

Preferably each retaining cover comprises a retaining flange extending axially beyond a peripheral edge of the plurality of accessory cases to retain the plurality of accessory cases in the substantially radial position.

Preferably the at least one support plate comprises:

a plurality of substantially equidistantly spaced apart apertures, and wherein the retaining cover comprises:

a biasing member; and a positioning cam connected to the biasing member, wherein the positioning cam is urged into an aperture via the action of the biasing member when the support plate pivots to a certain angle with respect to the retaining cover so that the retaining cover and the support plate can be fixed firmly together.

Preferably the number of apertures, the number of radial guide slots and the number of accessory cases is equal.

Preferably the apparatus further comprises:

a manually operable knob mounted on an outer face of the retaining cover and connected to the support plate.

Preferably the apparatus further comprises:

a locating member arranged between the knob and a first retaining cover.

Particularly preferably the rotary connection shaft comprises:

a union body extending from an interior of the knob, a connection piece connected to a second retaining cover and a coupling rod mounted between the union body and connection piece, wherein the union body passes through the first retaining cover and is connected to a first support plate and the coupling rod and wherein the connection piece passes through the second retaining cover and is connected to a second support plate and the coupling rod.

The union body may pass through the central aperture of the first retaining cover and the hub hole of the support plate. The union body may have a radial projection inserted into a slot of the support plate. An end of the coupling rod may be sleeved on the union body and may have a slot in which is inserted the radial projection. The connection piece may pass through the central aperture of the retaining cover and an end of the coupling rod may be sleeved on the connection piece.

Preferably the apparatus further comprises:

a clamping bolt passing through and fixing the knob, the union body, the coupling rod and the connection piece.

Preferably the rotary connection shaft is positioned between the retaining covers and is connected to the rotary support plates, wherein the rotary connection shaft comprises:

a union body inserted in each of the retaining covers, a connection piece and a coupling rod connected between the union body and connection piece, wherein the union body is fixed to the support plate and coupling rod simultaneously and the connection piece is fixed to the support plate and the coupling rod simultaneously.

Preferably the carousel further comprises:

one or more supporting brackets for supporting the accessory cases, wherein the brackets are connected in divergent fashion to the pair of axially spaced apart retaining covers. For this purpose, the retaining covers may comprise one or more stirrups connectable to an end of the bracket.

Preferably each supporting bracket comprises: a fixing member for fixing the apparatus to a fixed surface. The supporting bracket is typically substantially U-shaped.

In a further embodiment the present invention provides an apparatus for storing accessory cases characterized in that it comprises:

multiple accessory cases for storing accessories of power tools; and joint plates which are associated with the accessory cases for locating; and support elements having grooves, wherein the accessory cases are capable of rotating with respect to the support elements and the accessory cases can be extracted when rotating to align with the groove.

BRIEF DESCRIPTION OF THE DRAWINGS

The present invention will now be described in a non-limited sense with reference to the accompanying Figures in which common reference numerals represent corresponding parts throughout.

DESCRIPTION OF THE PREFERRED EMBODIMENTS

Figure 1:
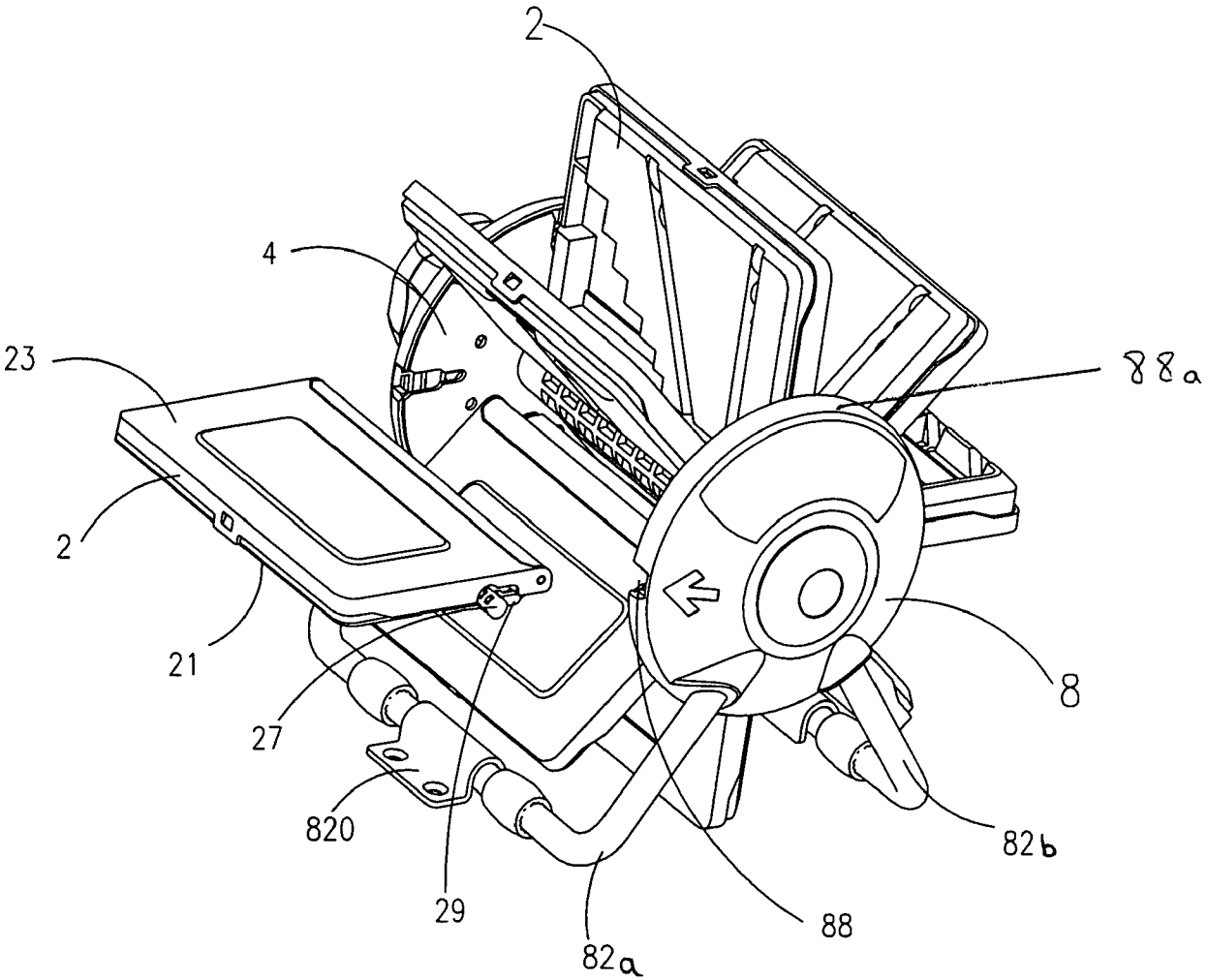
FIG. 1 is a perspective side view of an apparatus according to a first embodiment of the present invention.
Figure 2:
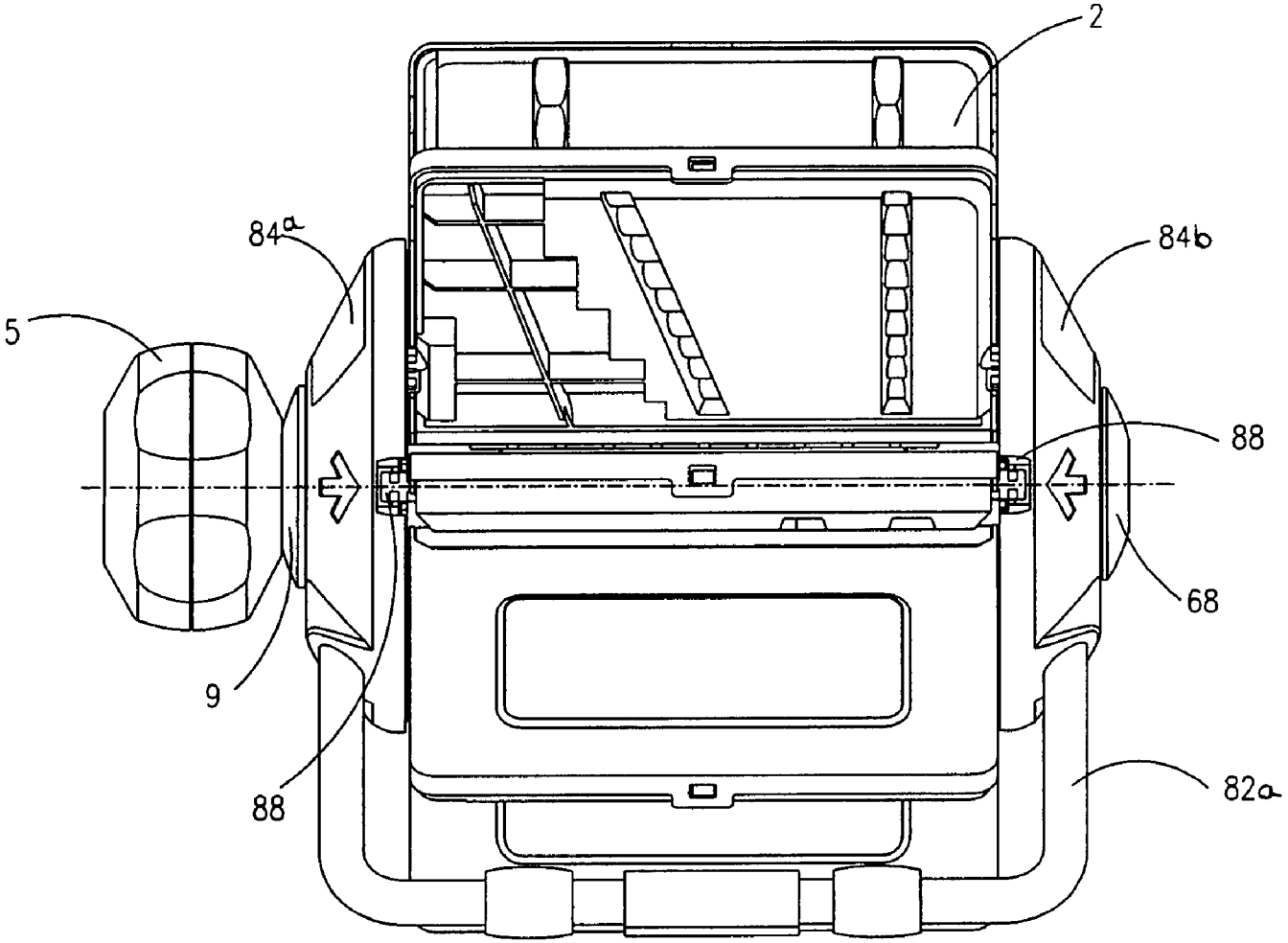
FIG. 2 is a front view of the apparatus in FIG. 1.
Figure 4:
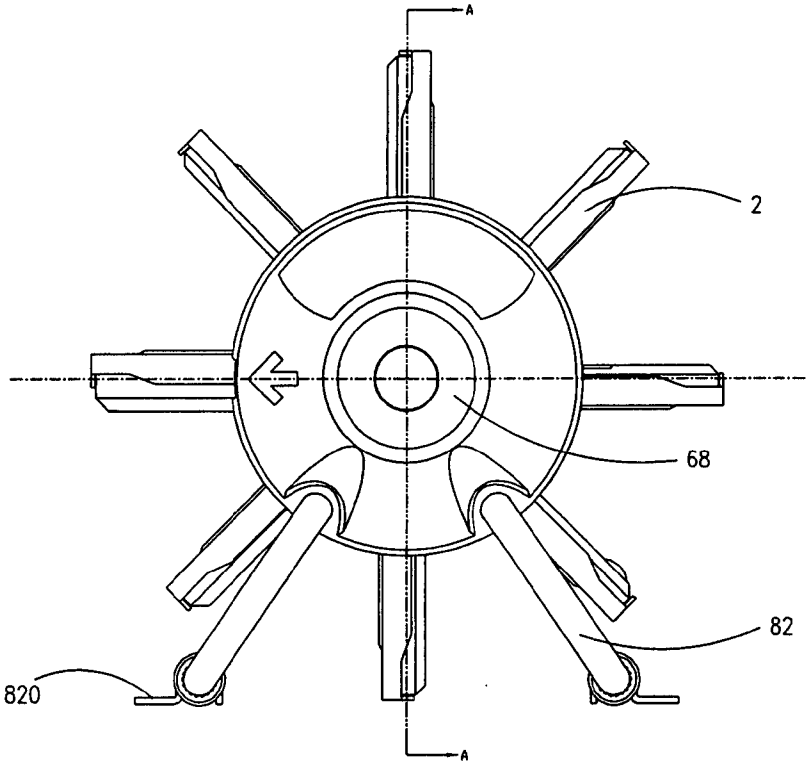
FIG. 4 is a right view of the apparatus in FIG. 2.
Figure 3:
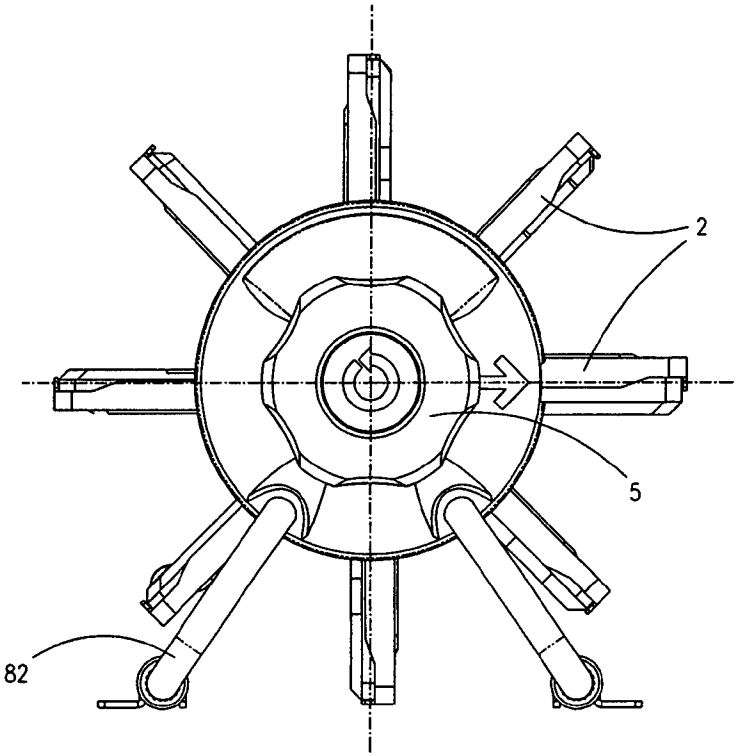
FIG. 3 is a left view of the apparatus in FIG. 2.

Referring to FIG. 1, an apparatus according to a first embodiment of the invention comprises multiple accessory cases 2 supported radially in a horizontally disposed carousel 8. The carousel comprises a pair of support plates 4 fixed to opposite ends of a rotary connection shaft 6. Each support plate 4 is made of plastic and is substantially circular. Referring in particular to FIGS. 2 to 4 and 7, the carousel 8 further comprises a pair of substantially U-shaped support brackets 82*a,b* which are connected in divergent fashion to a pair of axially spaced apart retaining covers 84*a,b*. Each retaining cover 84*a,b* is substantially cup-shaped with a central aperture 840 and a concave inner face 86 extending into an axial retaining collar 88*a*. Each support plate 4 is supported at the rear face of one of the retaining covers 84*a,b* on support ribs upstanding from the concave inner face 86.

The multiple accessory cases 2 may be used to store different accessories of various kinds of power tool (not shown) such as screw and drill bits. Each accessory case 2 comprises a base body 21 and a transparent cover 23. Various compartments are disposed in the base body 21 for receiving accessories. On each lateral edge of the accessory case 2 is disposed a sliding member 27 and an adjacent guide block 29. The sliding member 27 is substantially cylindrical and the guide block 29 is substantially cuboidal.

Figure 10:
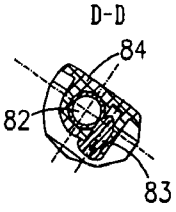
FIG. 10 is a cross-sectional view according to the D-D line in FIG. 7.
Figure 7:
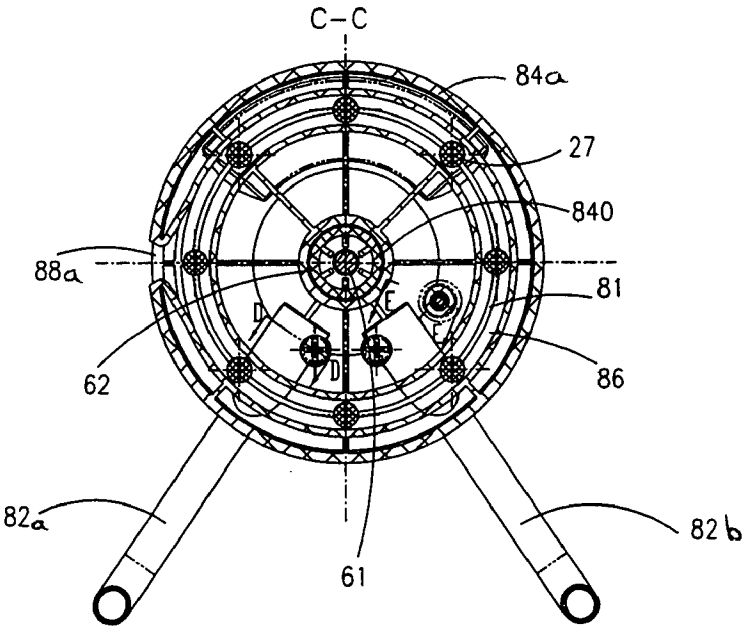
FIG. 7 is a cross-sectional view according to the C-C line in FIG. 5.
Figure 6:
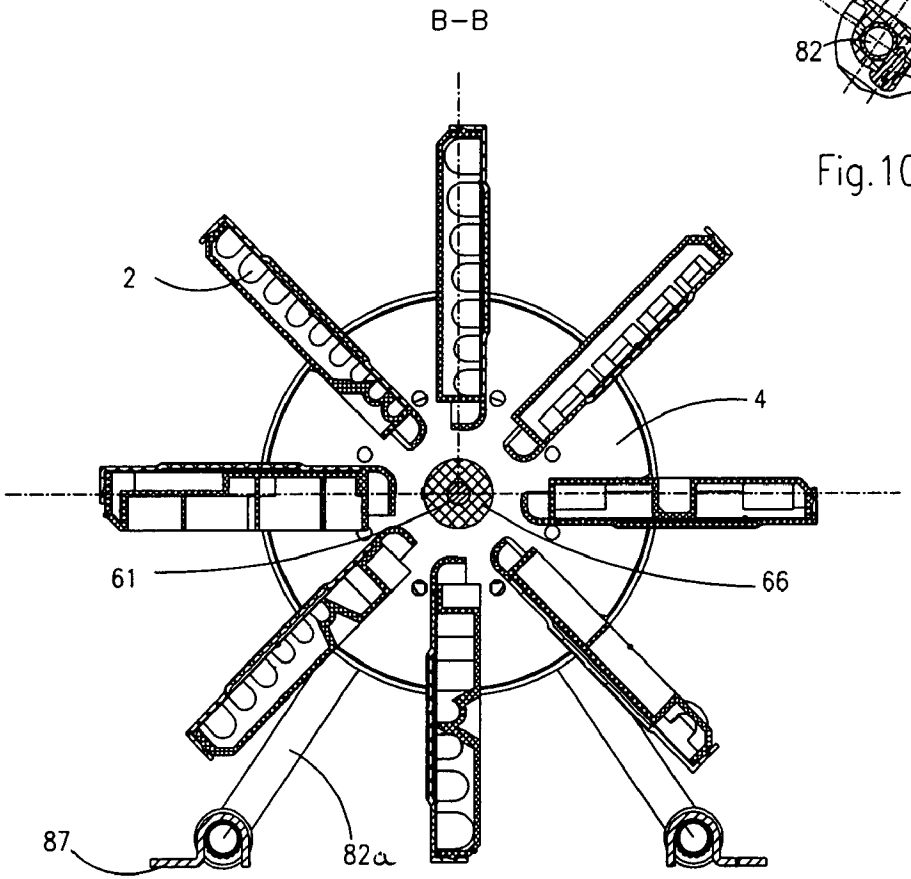
FIG. 6 is a cross-sectional view according to the B-B line in FIG. 5.

Referring to FIG. 10, each of a plurality of stirrups 83 are disposed radially on the concave inner face 86 of the retaining cover 84*a,b* to receive an end of the bracket 82*a,b*. The brackets 82*a,b* are made of a metal such as aluminium and the retaining covers 84*a,b* are made of plastic. Each bracket 82*a,b* is provided with a fixing plate 820 so as to fix the apparatus (if desired) to the ground or a wall with screws.

A groove 88 is disposed in the retaining collar 88*a* and the grooves 88 in the pair of retaining covers 84*a,b* are in axial alignment. The diameter of the concave inner face 86 is a little greater than the diameter of the sliding member 27 such that the sliding member 27 is capable of sliding into the concavity. An annular support rib 81 is disposed on the concave inner face 86 to support the periphery of the sliding member 27. The axial retaining collar 88*a* extends axially to a lateral edge of the plurality of accessory cases 2 to confine the lateral sliding member 27 in the concavity.

Figure 5:
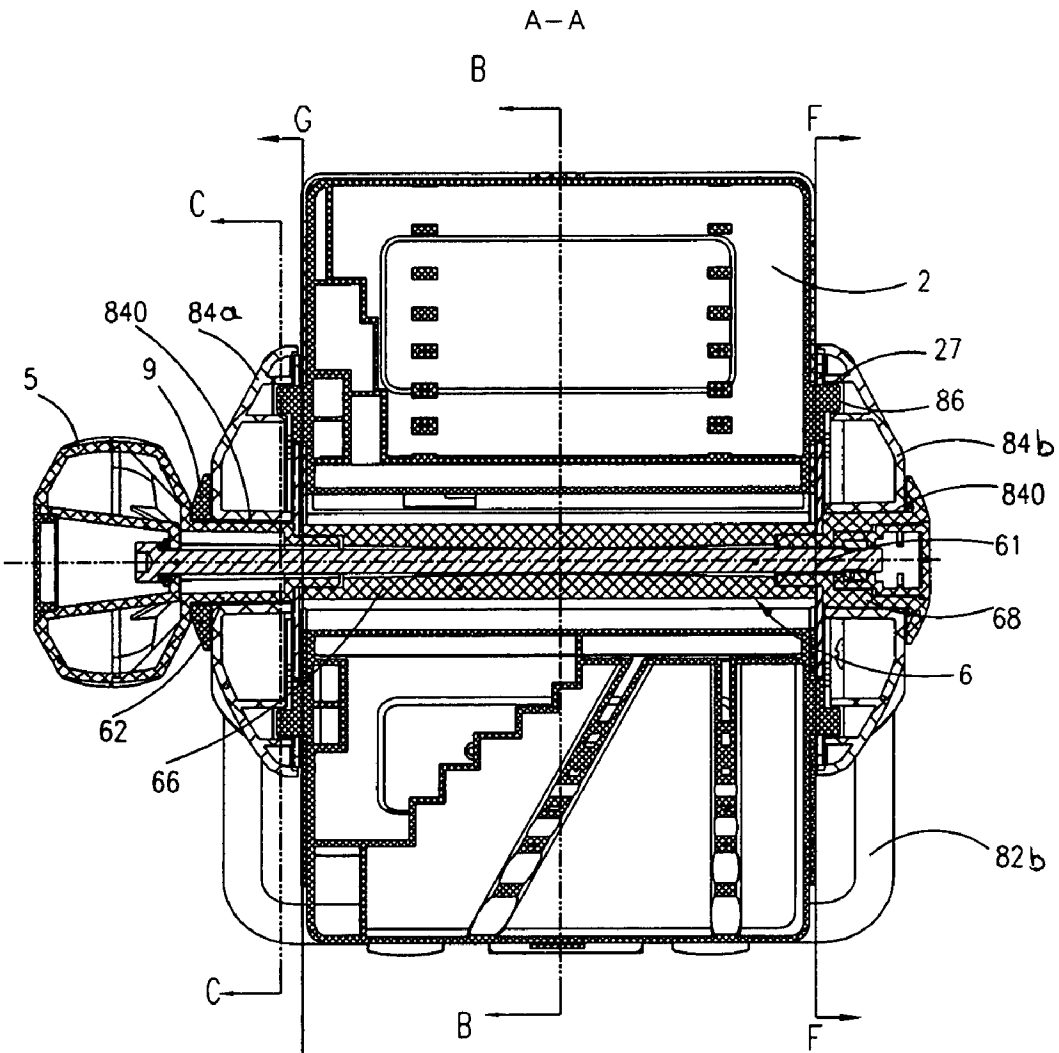
FIG. 5 is a cross-sectional view according to the A-A line in FIG. 4.
Figure 9:
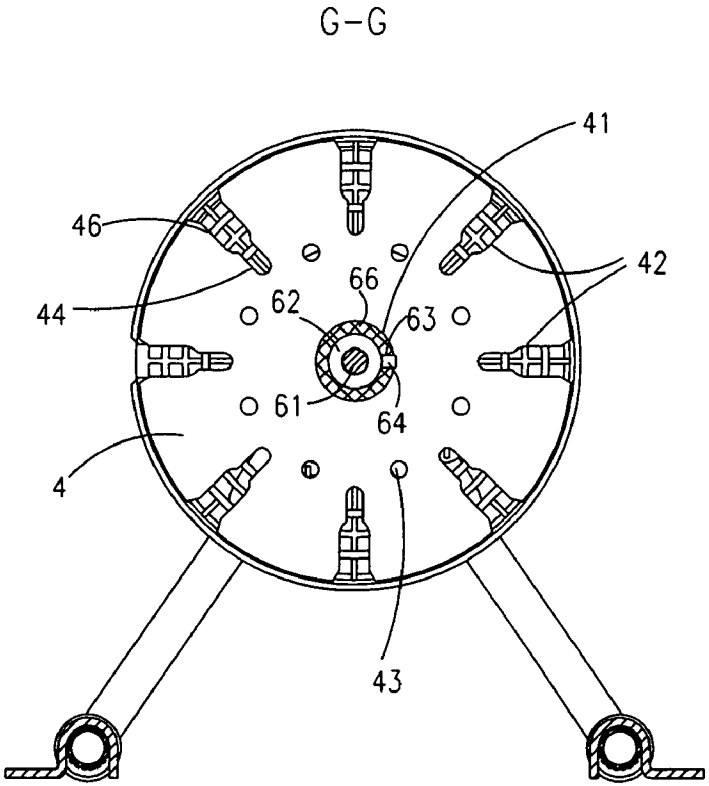
FIG. 9 is a cross-sectional view according to the G-G line in FIG. 5 (accessory cases removed)
Figure 8:
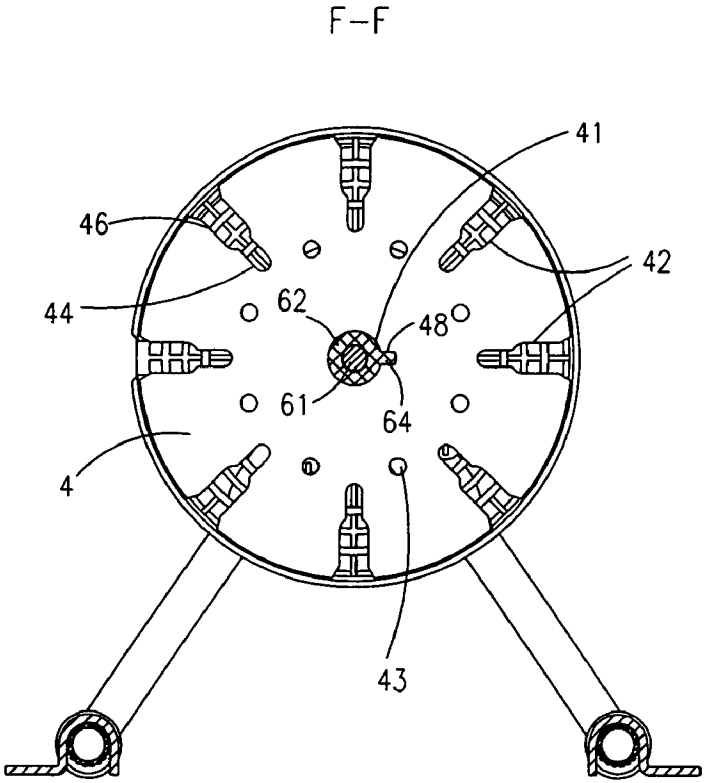
FIG. 8 is a cross-sectional view according to the F-F line in FIG. 5 (accessory cases removed)

Referring to FIGS. 5, 8 and 9, a plurality of radial guide slots 42 are equidistantly spaced circumferentially on each support plate 4. The number of radial slots 42 matches the maximum number of accessory cases 2. Each radial guide slot 42 comprises a first slot portion 44 and a second slot portion 46. The width of the first slot portion 44 is substantially equal to the width of the guide block 29 and the width of the second slot portion 46 is greater than the first slot portion 44. An aperture 43 is located in the support plate 4 between each radial guide slot 42 and the apertures 43 are substantially equidistantly spaced apart. Each support plate 4 also contains a hub hole 41 and a third slot 48 communicating with the hub hole 41.

Figure 11:
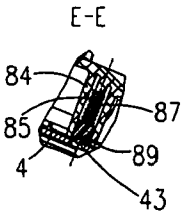
FIG. 11 is a cross-sectional view according to the E-E line in FIG. 7.

With reference to FIG. 11, a positioning hole 85 is arranged on one of the retaining covers 84*a*. A part of a positioning cam 89 fixed to a spring 87 extends out of the positioning hole 85. The positioning cam 89 is urged into an aperture 43 via the action of the spring 87 when the support plate 4 pivots to a certain angle with respect to the retaining cover 84*a* so that the retaining cover 84*a* and the support plate 4 can be fixed together firmly.

Referring to FIGS. 1 and 5, the apparatus further comprises a knob 5 for manually rotating the accessory cases 2. The knob 5 is disposed on the outer convex face of one of the retaining covers 84*a*. A locating member 9 is positioned between the knob 5 and the retaining cover 84*a*. The rotary connection shaft 6 includes a union body 62 passing through the central aperture 840 of the retaining cover 84*a* and the hub hole 41 of the support plate 4. Referring to FIG. 8, the union body 62 has a radial projection 64 inserted into the third slot 48 of the support plate 4. The rotary connection shaft 6 also comprises a coupling rod 66, a connection piece 68 and a clamping bolt 61 which is inserted in the knob 5 to fix the components firmly together. Referring to FIG. 9, one end of the coupling rod 66 is sleeved on the union body 62 and has a fourth slot 63 in which is inserted the radial projection 64. The connection piece 68 passes through the central aperture 840 of the retaining cover 84*a* and an end of the coupling rod 66 is sleeved on the connection piece 68. The connection (not shown) between the connection piece 68 and support plate 4 is the same as the connection between the union body 62 and the coupling rod 66 (see FIG. 9).

Referring to FIG. 10, to assemble the first embodiment of the invention, the brackets 82*a,b* are firstly inserted into the retaining covers 84*a,b* by fixing them firmly in the stirrups 83. Referring to FIG. 11, the support plates 4 are positioned at the rear faces of corresponding retaining covers 84*a,b* such that one of the radial guide slots 42 aligns with the grooves 88 and the position cam 89 is inserted into a corresponding opening 43 of the support plate 4. The coupling rod 66 with the hollow interior is inserted into the support plates 4 and is aligned with the hub holes 41. The locating member 9 is sleeved on the union body 62. The knob 5 is inserted into the central aperture 840 of the corresponding retaining cover 84 and hub hole 41 of the support plate 4. The projection 64 of the union body 62 is inserted into the third slot 48 of the support plate 4 and the fourth slot 63 of the coupling rod 66. The connection piece 68 is then connected to the coupling rod 66. The clamping bolt 61 is inserted in the knob 5, union body 62, coupling rod 66 and connection piece 68 to fasten them together. Referring to FIG. 10, the sliding members 27 are inserted into corresponding grooves 88 of the retaining covers 84*a,b* so that the two guide blocks 29 insert into the first slot portions 44. The two sliding members 27 pass through the second slot portion 46 and are received in the concavity. The knob 5 is rotated until the positioning cam 89 is urged into the aperture 43 of the support plate 4. Further radial guide slots 42 of support plates 4 may be selectively rotated to align with the grooves for other accessory cases to be added in the same fashion. To disassemble the apparatus, an accessory case 2 is rotated (directly or using the knob 5) into alignment with the grooves 88. The accessory case 2 can then be dismounted from the apparatus conveniently.

Figure 12:
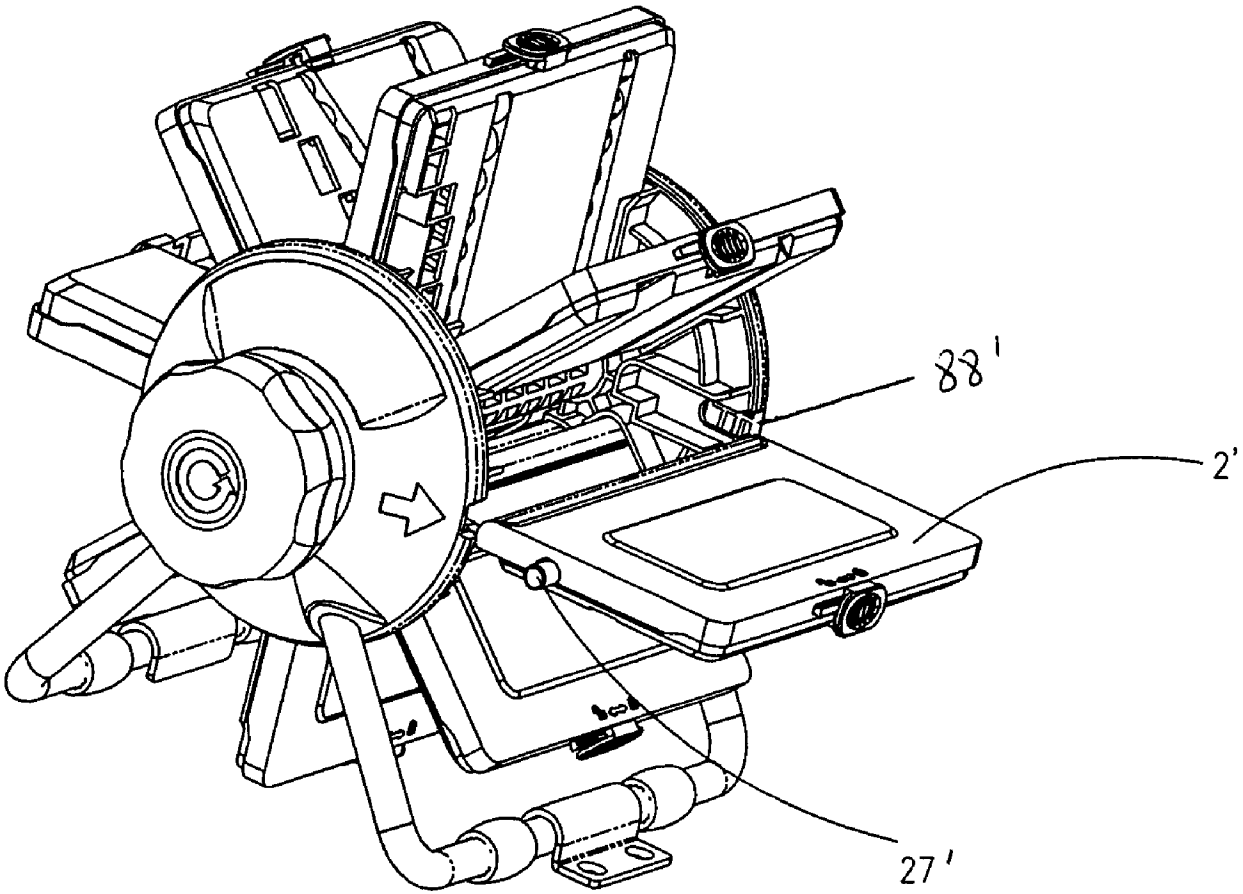
FIG. 12 is a side view of an apparatus according to a second embodiment of the present invention.
Figure 14:
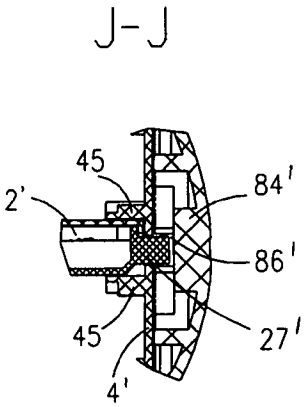
FIG. 14 is a cross-sectional view according to the J-J line in FIG. 13.
Figure 13:
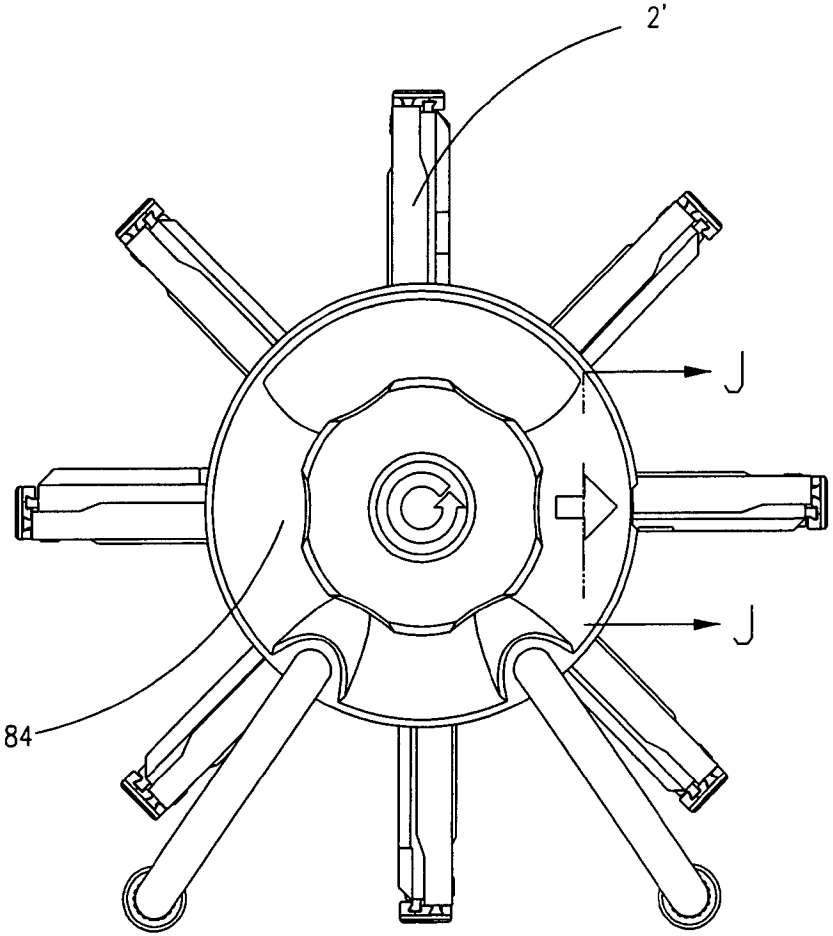
FIG. 13 is a left view of the apparatus in FIG. 12.

Referring to FIGS. 12 to 14, there is illustrated a second embodiment of the invention. The construction is similar to the first embodiment and so reference numerals are shared and the detailed description will be brief. Each accessory case 2' is provided with a pair of cylindrical sliding members 27' but no guide blocks (29 in the first embodiment). Each sliding member 27' is inserted into a groove 88' of the retaining cover 84'*a,b*, passes through the radial guide slot 43' and is received in the concavity of the retaining cover 84*a,b* defined by the concave inner surface 86'. Each support plate 4' further comprises a plurality of projecting guide walls 45 surrounding each radial guide slot 43 to slidingly receive the lateral edge of the accessory cases 2'.

Figure 15:
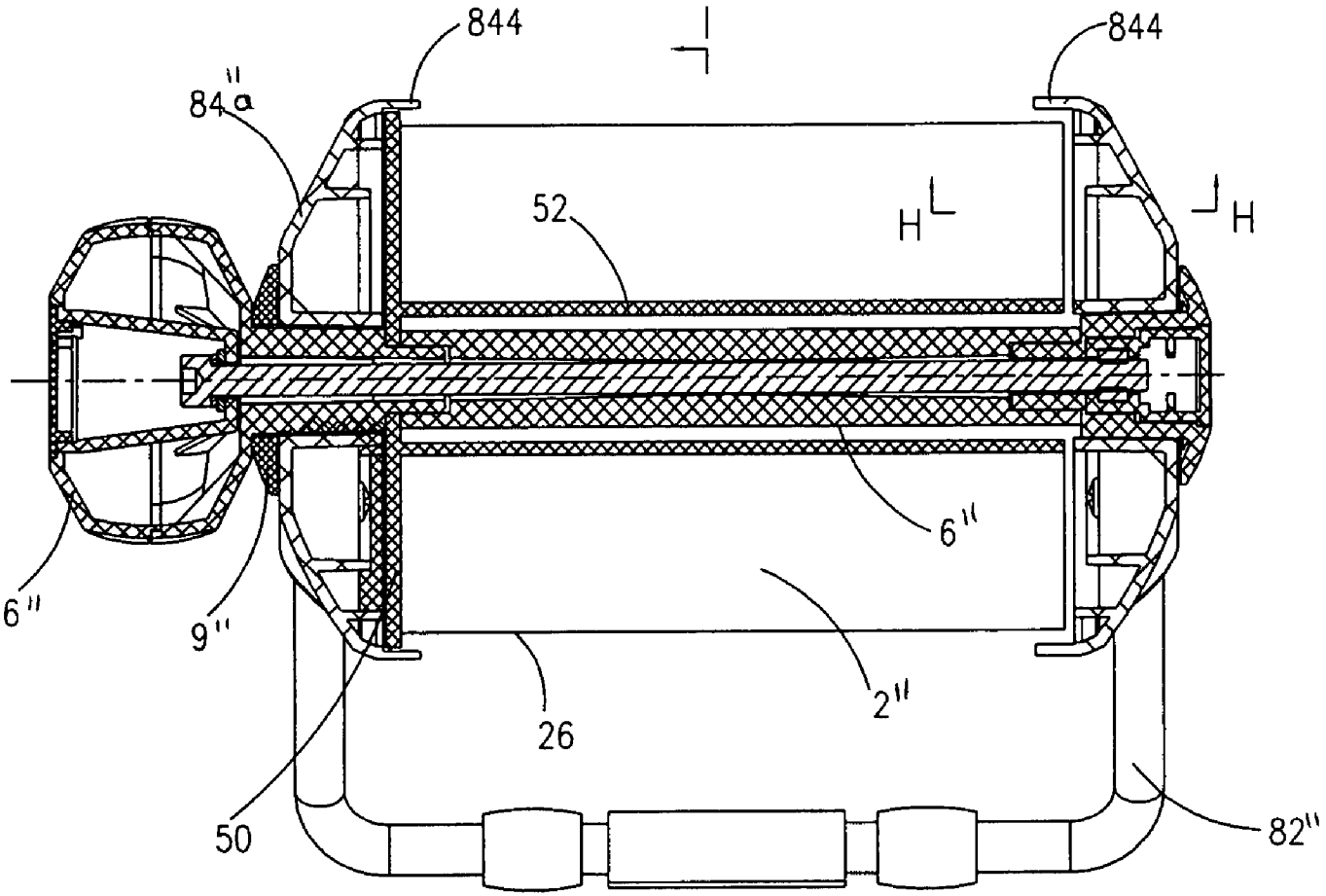
FIG. 15 is a cross-sectional view of an apparatus according to a third embodiment of the present invention.
Figure 16:
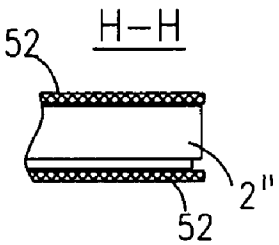
FIG. 16 is a cross-sectional view according to the H-H line in FIG. 15.
Figure 17:
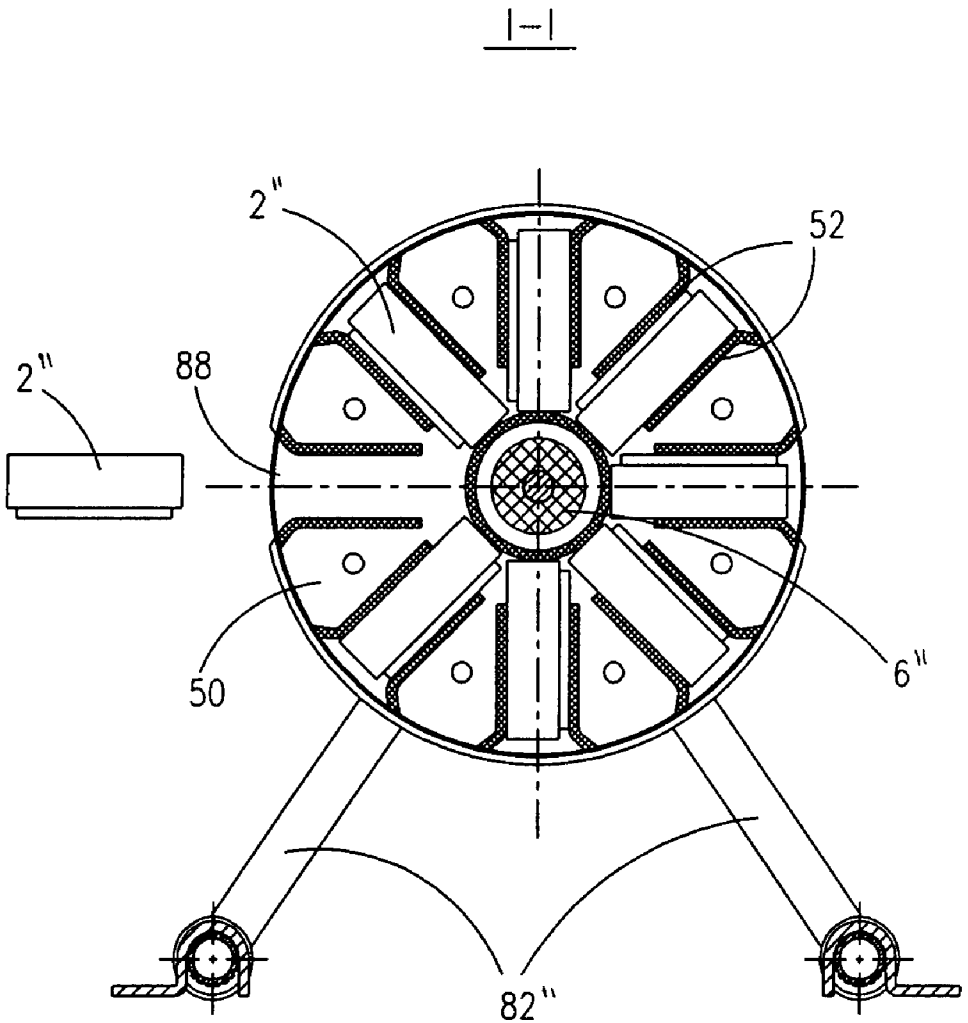
FIG. 17 is a cross-sectional view according to the I-I line in FIG. 15.

With reference to FIGS. 15 and 17, there is illustrated a third embodiment of the invention. The construction is similar to the first and second embodiments and so reference numerals are shared and the detailed description will be brief. The apparatus is provided with a support plate 50 supported between the retaining cover 84"*a* and an edge of the multiple accessory cases 2". Multiple pairs of radial guide arms 52 extend axially away from the support plate 50. Each accessory case 2" can be inserted between a pair of radial guide arms 52. Each retaining cover 84"*a,b* extends axially inwardly into an annular retaining flange 844 covering the peripheral end of the accessory cases 2" so as to retain the accessory cases 2" in the support plates 50. When the accessory case 2" rotates to align with the groove 88", it can be removed.

The foregoing description merely explains and illustrates the invention and the invention is not limited thereto except insofar as the appended claims are so limited, as those skilled in the art that have the disclosure before them will be able to make modifications without departing from the scope of the invention.

I claim:

1. An apparatus for storing a plurality of accessory cases comprising:

a carousel;

a plurality of accessory cases for storing power tool accessories mounted substantially radially on the carousel, wherein each of the plurality of accessory cases is selectively dismountable radially from the carousel only at one or more rotationally selected positions, a rotary connection shaft for rotating the plurality of accessory cases;

a pair of support plates joined to end of the rotary connection shaft, wherein the pair of support plates supports each of the plurality of accessory cases in a substantially radial position; and a pair of retaining covers mounted adjacent to the ends of the connection shaft to retain each of the plurality of accessory cases in the substantially radial position, wherein each of the plurality of accessory cases is selectively dismountable from the carousel only at one or more positions of the pair of support plates relative to the pair of retaining covers selected by rotation of the pair support plates relative to the pair of retaining covers;

wherein each accessory case further comprises a guide block element adjacent to each one of a pair of lateral members, and a radial guide slot on each support plate comprising a first slot portion and a second slot portion communicating with the first slot portion, wherein the guide block is slidable into the first slot portion and the width of the second slot portion is greater than the width of the first slot portion so that each lateral sliding member is slidable through and out of the second slot portion into the volume between the retaining cover and the support plates.

2. An apparatus as claimed in claim 1 wherein each accessory case is selectively dismountable from the carousel only at a single rotationally selected position.

3. An apparatus as claimed in claim 1 wherein each retaining cover comprises a retaining collar or retaining flange for retaining the plurality of accessory cases in the substantially radial position, wherein each retaining collar or retaining flange has a groove and wherein the grooves of each retaining collar or retaining flange are in axial alignment so as to permit one of the plurality of accessory cases when rotationally aligned with the grooves to be dismounted radially.

4. An apparatus as claimed in claim 3 wherein the at least one support plate is a pair of support plates joined to opposite ends of the rotary connection shaft and supported at the rear face of the retaining covers.

5. An apparatus as claimed in claim 4 wherein the radial guide slots are circumferentially spaced on the support plates.

6. An apparatus as claimed in claim 5 wherein each retaining cover comprises a retaining collar extending axially to a lateral edge of the plurality of accessory cases to confine the lateral sliding member in the volume between the retaining cover and the support plates to retain the plurality of accessory cases in the substantially radial position.

7. An apparatus as claimed in claim 5 wherein each support plate further comprises a plurality of axially projecting guide walls surrounding each radial guide slot to slidingly receive the lateral edge of the accessory cases.

8. An apparatus as claimed in claim 3 wherein the at least one support plate is a single support plate joined to an end of the rotary connection shaft and supported at the rear face of one of the retaining covers.

9. An apparatus as claimed in claim 8 wherein the support plate comprises a plate body supported at the rear face of one of the retaining covers and multiple pairs of radial guide arms extending axially from the plate body.

10. An apparatus as claimed in claim 9 wherein each retaining cover comprises a retaining flange extending axially beyond as peripheral edge of the plurality of accessory cases to retain the plurality of accessory cases in the substantially radial position.

11. An apparatus as claimed in claim 1 wherein the at least one support plates comprise:

as plurality of substantially equidistantly spaced apart apertures, and wherein the retaining cover comprises:

a biasing member and a positioning cam connected to the biasing member, wherein the positioning cam is urged into an aperture the action of the biasing member when the support plate pivots to a certain angle with respect to the retaining cover so that the retaining cover and the support plate can be fixed firmly together.

12. An apparatus as claimed in claim 11 wherein the number of apertures, a number of radial guide slots and the number of accessory cases is equal.

13. An apparatus as claimed in claim 1 further comprising:

a manually operable knob mounted on an outer face of the retaining cover and connected to the support plate.

14. An apparatus as claimed in claim 13 further comprising:

a locating member arranged between the knob and a first retaining cover.

15. An apparatus as claimed in claim 14 wherein the rotary connection shaft comprises:

a union body extending from an interior of the knob;

a connection piece connected to a second retaining cover; and a coupling rod mounted between the union body and connection piece, wherein the onion body passes through the first retaining cover and is connected to a first of the support plates and the coupling rod and wherein the connection piece passes through the second retaining cover and is connected to as second of the support plates and the coupling rod.

16. An apparatus as claimed in claim 15 further comprising:

a clamping bolt passing through and fixing the knob, the union body, the coupling rod and the connection piece.

17. An apparatus as claimed in claim 1 wherein the rotary connection shaft is positioned between the retaining covers and is connected to the rotary support plates, wherein the rotary connection shaft comprises:

a union body inserted in each of the retaining covers, a connection piece and a coupling rod connected between the union body and connection piece, wherein the union body is fixed to the support plate and coupling rod simultaneously and the connection piece is fixed to the support plate and the coupling rod simultaneously.

18. An apparatus as claimed in claim 1 wherein the carousel further comprises:

one or more supporting brackets for supporting the accessory cases, wherein the brackets are connected in divergent fashion to a pair of axially spaced apart retaining covers.

19. An apparatus as claimed in claim 18 wherein each supporting bracket comprises: a fixing member for fixing the apparatus to a fixed surface.

* * * * *